US010623871B2

(12) United States Patent
Oesch et al.

(10) Patent No.: US 10,623,871 B2
(45) Date of Patent: Apr. 14, 2020

(54) HEARING ASSISTANCE SYSTEM WITH AUTOMATIC SIDE DETECTION

(71) Applicant: SONOVA AG, Staefa (CH)

(72) Inventors: Yves Oesch, Neuchatel (CH); Christoph Leist, Rapperswil (CH); Marius Rufenacht, Volketswil (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/304,568

(22) PCT Filed: Jun. 1, 2016

(86) PCT No.: PCT/EP2016/062349

§ 371 (c)(1),
(2) Date: Nov. 26, 2018

(87) PCT Pub. No.: WO2017/207044

PCT Pub. Date: Dec. 7, 2017

(65) Prior Publication Data

US 2019/0297431 A1 Sep. 26, 2019

(51) Int. Cl.
*H04R 25/00* (2006.01)

(52) U.S. Cl.
CPC ..... *H04R 25/505* (2013.01); *H04R 25/552* (2013.01); *H04R 25/554* (2013.01);
(Continued)

(58) Field of Classification Search
CPC .... H04R 1/345; H04R 1/1091; H04R 1/2803; H04R 25/00; H04R 3/04; H04R 29/00; H04R 2460/07
(Continued)

(56) References Cited

U.S. PATENT DOCUMENTS 8,699,735 B2 4/2014 Kral et al.
2008/0174550 A1* 7/2008 Laurila ..... A63F 13/02 345/158
(Continued)

FOREIGN PATENT DOCUMENTS

EP 1562399 8/2005
EP 2451187 * 5/2011
(Continued)

OTHER PUBLICATIONS

International Search Report and Written Opinion received in International Application No. PCT/EP161062349, dated Feb. 15, 2017.

*Primary Examiner* — William A Jerez Lora
(74) *Attorney, Agent, or Firm* — ALG Intellectual Property, LLC

(57) ABSTRACT

There is provided a hearing assistance system, comprising at least a first hearing device to be worn at one ear of a user, the first hearing device comprising a 3-axes accelerometer sensor for generating an acceleration signal indicative of the acceleration of the first hearing device, and an orientation sensor for generating an orientation signal indicative of the azimuthal orientation of the first hearing device, wherein the orientation sensor is selected from the group consisting of a 3-axes magnetic compass sensor and a 3-axes gyroscope sensor, and wherein the system comprises a judgement unit for judging, by analyzing the acceleration signal and the orientation signal of the first hearing device, whether the first hearing device is presently worn at the right ear or at the left ear of the user.

38 Claims, 2 Drawing Sheets

(52) U.S. Cl.
CPC .. *H04R 2225/021* (2013.01); *H04R 2225/023* (2013.01); *H04R 2225/43* (2013.01); *H04R 2460/07* (2013.01)

(58) Field of Classification Search
USPC ..... 381/56, 58, 312
See application file for complete search history.

(56) References Cited

U.S. PATENT DOCUMENTS

| | | | | |
|---|---|---|---|---|
| 2010/0067707 | A1* | 3/2010 | Schwerdtner ..... | H04R 25/552 381/23.1 |
| 2012/0003937 | A1* | 1/2012 | Zhong ..... | H04M 1/6066 455/41.3 |
| 2012/0114132 | A1* | 5/2012 | Abrahamsson ..... | H04R 1/1016 381/74 |
| 2014/0093088 | A1* | 4/2014 | Tachibana ..... | H04R 1/1041 381/58 |
| 2015/0281852 | A1* | 10/2015 | Sacha ..... | H04R 25/30 381/331 |

FOREIGN PATENT DOCUMENTS

| | | | |
|---|---|---|---|
| EP | 2451187 | | 5/2012 |
| EP | 2908549 | | 8/2015 |
| EP | 2908550 | | 8/2015 |
| EP | 2991380 | * | 8/2015 |
| EP | 2925021 | | 9/2015 |
| EP | 2991380 | | 3/2016 |

* cited by examiner

HEARING ASSISTANCE SYSTEM WITH AUTOMATIC SIDE DETECTION

The invention relates to a hearing assistance system comprising one or two hearing devices to be worn at ear level.

Typically, hearing devices, such as hearing aids, are used in a binaural fitting, i.e. one hearing device is used at each ear of the patient. Usually, each hearing device is assigned to the respective side during fitting. Since the hearing loss may be different for the two ears, also the setting of the fitting parameters may be different for the two hearing devices of a binaural fitting. Therefore, it is important to avoid an inadvertent interchange of the hearing devices after fitting, since then the fitting of the respective hearing device would no longer match with the hearing loss of the ear at which it is worn.

A typical known process for binaural fitting requires that the audiologist puts a mechanical color marking on each hearing device after first fitting, wherein the color indicates the side at which the hearing device is to be worn. For example, after the audiologist has assigned the "right side" to a certain hearing device in the fitting software (with the fitting parameters being selected according to the audiogram of the right ear) he may put a red marking on that hearing device, whereas the "left ear" hearing device is provided with a blue marking (such color marking may be a simple color dot). However, an error by the audiologist (for example, by using the wrong color dot) may result in inverted fitting parameter sets of the two hearing devices (in this case, the hearing device worn at the right ear actually would use the left ear fitting parameter set). Another potentially critical action is cleaning of the hearing devices, wherein the user has to remove parts like the earhook and acoustic tubes/domes for cleaning, so that the side at which the hearing device is usually used is no longer obvious. At that point of time the only remaining indicator is the small color dot on the housing of the hearing device. However, this is useful only in case that the patient is aware of the color code, i.e. the user has to know that "red" means right side and "blue" means left side. Another potentially critical situation may occur during servicing of the hearing device at a service center, wherein the operator may swap (or forget to install) the color coding (color dots) when the casing of the hearing device is opened or gets exchanged.

US 2010/0067707 A1 relates to a wireless binaural hearing aid system, including an automatic detection of the side of the head at which each hearing aid is presently worn. The side is determined from the difference in signal strength and/or phase of the electromagnetic signal received by two probe coils in each hearing aid from the respective contralateral hearing aid. The side detection is used for selecting the correct fitting parameter set.

US 2015/0281852 A1 relates to a hearing aid comprising a three-axes GMR (Giant Magneto Resistance) sensor for measuring magnetic fields. The sensor may be used for telecoil detection, navigation, anti-theft protection by motion detection, and on/off switching of the hearing aid based on detection of relative movement between that hearing aid and the other hearing aid of a binaural system.

EP 2 908 549 A1 and EP 2 908 550 A1 relate to a hearing aid comprising a three-axes accelerometer and a magnetic compass sensor for detecting, for example, movement of the head of the user in order to compensate for such head movement by appropriate audio signal processing, for detecting the level of the physical activity of the user in order to automatically adjust the hearing aid settings to the physical activity, and for detecting loss of the hearing aid by detecting free-fall events.

U.S. Pat. No. 8,699,735 B2 relates to a hearing aid comprising an identification element for visibly identifying the hearing device as a left ear or right ear hearing device.

EP 1 562 399 A2 relates to a pair of hearing aids comprising an information carrier for enabling tactile distinction between the left hearing aid the right hearing aid; in addition, the hearing aids may provide for an acoustic signal for distinguishing the left ear hearing aid and the right ear hearing aid.

It is an object of the invention to provide for a hearing assistance system which is able to prevent use of a hearing device of the system at a side of the head for which it is not configured. It is a further object of the invention to provide for a corresponding method.

According to the invention, these objects are achieved by a hearing assistance system as defined in claims 1 and 14 and a method as defined in claims 32 and 35, respectively.

The invention is beneficial in that, by providing the hearing device(s) with a three-axes accelerometer sensor and by judging, by analyzing the acceleration signal during rotation of the user's head, whether the hearing device is worn at the right ear or the left ear of the user, at any time during use of the hearing device it can be automatically detected and monitored whether the hearing device is presently worn at the "correct" side of the user's head, thereby preventing inadvertent interchange of the use side.

In the embodiment of claims 1 and 33 a three-axes magnetic compass sensor or a three-axes gyroscope sensor is provided in the hearing device for generating an orientation signal which is indicative of the azimuthal orientation of the hearing device, so that the rotation of the user's head can be detected by the hearing device according to the orientation signal. In this case, the hearing device is able to detect the side at which it is presently worn on its own, i.e. autonomously, without the need for data from a hearing device worn at the other ear of the user.

In the embodiment of claims 14 and 36 the system does not require the use of a magnetic compass sensor, since the two hearing devices of a binaural system exchange their acceleration signals, so that the judgement concerning the use side is based on a comparison of the acceleration signals from both hearing devices. Thus, rotation of the user's head can be detected from the acceleration signals only, without the need for an additional orientation signal.

Preferred embodiments of the invention are defined in the dependent claims.

Hereinafter, examples of the invention will be illustrated by reference to the attached drawings, wherein.

Figure 1:
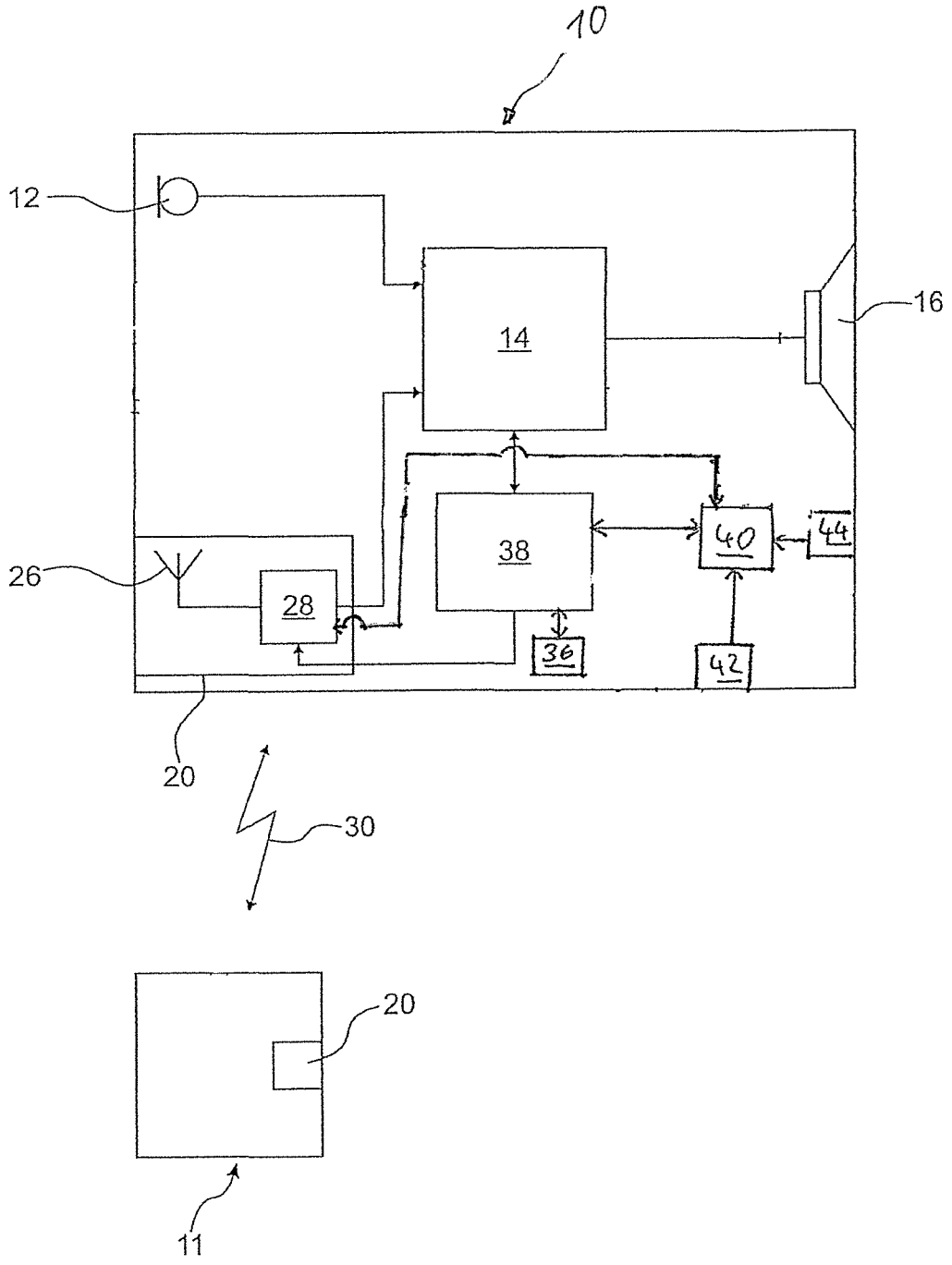
FIG. 1 is a block diagram of an example of a hearing assistance system according to the invention.

FIG. 1 is a block diagram of an example of a hearing assistance system comprising a first hearing device 10 to be worn at one ear of a user and a second hearing device 11 to be worn at the other ear of the user. The first and second hearing devices 10, 11 are ear level devices and together form a binaural hearing system. Preferably, the hearing devices 10, 11 are hearing instruments, such as RIC (Receiver in the canal), BTE (behind-the-ear), ITE (in-the-ear), ITC (in the canal) or CIC (completely-in-the-canal) hearing aids. However, the hearing devices, for example, also could be an auditory prosthesis, such as a cochlear implant device comprising an implanted cochlear stimulator and an external sound processor which may be designed as a BTE unit with a headpiece or as an integrated headpiece.

In the example of FIG. 1, the hearing devices 10, 11 are hearing aids comprising a microphone arrangement 12 for capturing audio signals from ambient sound, an audio signal processing unit 14 for processing the captured audio signals and an electro-acoustic output transducer (loudspeaker) 16 for stimulation of the user's hearing according to the processed audio signals (these elements are shown in FIG. 1 only for the hearing aid 10). For example, the audio signal processing in the unit 14 may include acoustic beamforming (in this case, the microphone arrangement 12 comprises at least two spaced apart microphones).

The hearing aids 10, 11 comprise a wireless interface 20 comprising an antenna 26 and a transceiver 28. The interface 20 is provided for enabling wireless data exchange between the first hearing aid 10 and the second hearing aid 11 via a wireless link 30 which serves to realize a binaural hearing assistance system, allowing the hearing aids 10, 11 to exchange audio signals and/or control data and status data, such as the present settings of the hearing aids 10, 11.

The interface 20 may also be provided for data exchange via a wireless link 30 from or to an external device (not shown), for example for receiving an audio data stream from an external device acting as an audio source, or data from a remote control device.

For example, the interface 20 may be adapted to operate at frequencies around 2.4 GHz in the ISM band, or in any other suitable frequency range, such as up to 10 GHz. Typically, the interface 20 is a Bluetooth interface, such as a Bluetooth Smart or a Bluetooth Smart Ready interface; alternatively, it may use another standard protocol, or it may be a proprietary interface.

The hearing aids 10, 11 also comprise a controller 38 for controlling operation of the hearing aids 10, 11, with the controller 38 acting on the signal processing unit 14 and the transceiver 28, and a memory 36 for storing data required for operation of the hearing aid 10, 11 and data required for operation of the interface 20, such as pairing/network data.

The hearing aid 10 further comprises a three-axes accelerometer sensor 42 for generating an acceleration signal indicative of the acceleration of the hearing aid 10 (hereinafter "acceleration signal") and an orientation sensor 44 for generating an orientation signal indicative of the azimuthal orientation of the hearing aid 10 (hereinafter "orientation signal").

The orientation sensor 44 may a 3-axes magnetic compass sensor or a 3-axes gyroscope sensor. A magnetic compass sensor is preferred due to its lower power consumption. The acceleration signal and the orientation signal are supplied to a judgement unit 40 for judging, by analyzing the acceleration signal and the orientation signal, whether the hearing aid 10 is presently worn at the right ear or at the left ear of the user. Further, the judgement unit 40 may receive also the orientation signal and the acceleration signal from the second hearing aid 11 via the wireless link 30 and the interface 20, so that the judgement unit 40, when judging whether the first hearing aid 10 is presently worn at the right ear or at the left ear of the user, may take into account not only the acceleration signal and the orientation signal of the first hearing aid 10, but also the corresponding signals of the second hearing aid 11. Thus, the reliability of the judgement may be enhanced compared to the case in which only the respective signals from one of the hearing aids 10, 11 is taken into account.

The judgement unit 40 communicates with the controller 38, so that the controller may control operation of the first hearing aid 10 according to the decision of the judgement unit 40. In particular, the controller 38 may cause the audio signal processing unit 14 to use that fitting parameter set which corresponds to the presently detected side (i.e. audio signal processing unit 14 operates either based on the right ear fitting or based on the left ear fitting). The respective fitting parameters for both ears are stored in a memory 36.

It is to be understood that the structure of the second hearing aid 11 substantially corresponds to that shown in FIG. 1 for the first hearing aid 10, i.e. typically all components are the same in both hearing aids 10, 11.

It is also to be understood that the judgment unit 40 is not necessarily a physical component; rather it may be implemented as an algorithm; typically, the judgement unit may be implemented as some software code running on the controller 38 and/or DSP 14.

According to a first example, which is illustrated in FIG. 1, the judgement unit 40 may use both the orientation signal and the acceleration signal in order to determine the side of the hearing device, wherein in the most simple case only the respective signals of one of the hearing aids are required, i.e. in this case there is no need to exchange the orientation signal and the acceleration signal between the two hearing aids 10, 11. Typically, the judgement unit 40 is caused by the controller 38 to perform a judgement concerning the side of the hearing aid once after each power-on of the hearing aid 10 (typically, actions which may result in an inadvertent interchange of the hearing aids 10, 11 take place when the hearing aid is not used, i.e. during times when power is turned off). Alternatively, the judgement unit 40 may be caused by controller 38 to periodically perform such judgement after each power-on of the hearing aid 10, so as to be able to correct a potential error in a first side judgement.

Once the judgement unit 40 is activated by the controller 38, an orientation signal generated by the orientation sensor 44 may be supplied to the judgement unit 40 which initiates/triggers a side judgement once a change of the azimuthal orientation of the hearing aid, as determined from a change of the orientation signal in time, is above a given threshold value, since this is an indication that the user rotates his head 50 (which rotation may be in a clockwise direction or in a counter-clockwise direction). The judgement unit 40 detects a clockwise rotation when the azimuthal component of the orientation signal increases in time, and it detects a counter-clockwise rotation when the azimuthal component of the orientation signal decreases in time. Of course this is valid along the whole range of azimuth angles, except for the 360°=0° position where an overlap occurs. This can be anyways managed by a suitable computation routine detecting this overlap.

Figure 2:
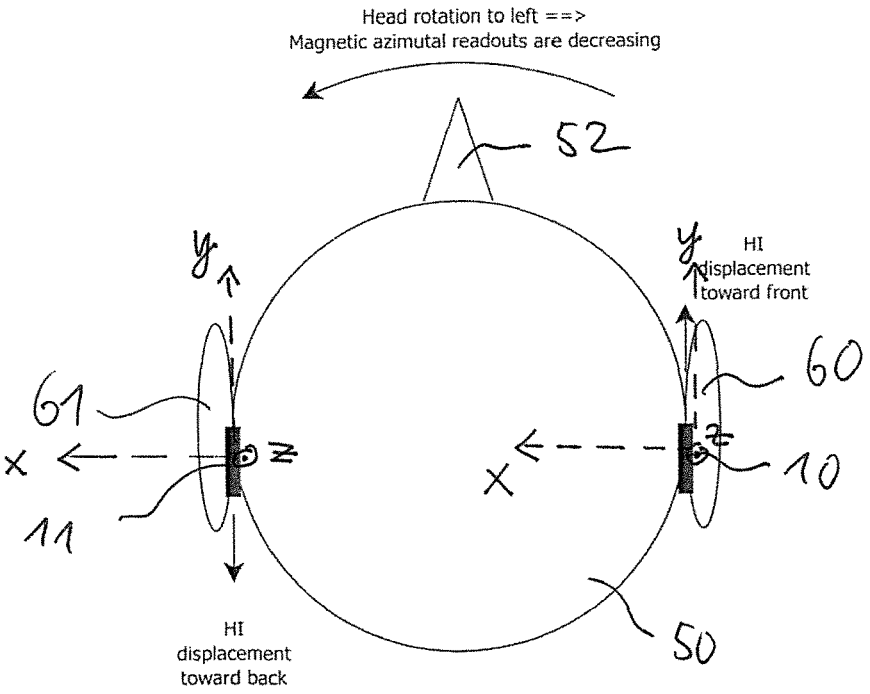
FIG. 2 is an illustration of an automatic side detection of a hearing assistance system of the invention according to a first example, wherein a top view of a user's head wearing two hearing devices is shown.

Once a head rotation has been detected, the judgement unit 40 integrates the acceleration signal over time in order to determine the direction of a tangential displacement of the respective hearing aid with regard to the user's head 50. To this end, each of the hearing aids may use its own coordinate system as illustrated in FIG. 2, which is stationary with regard to the respective hearing aid 10, 11, and wherein, for example, the x-axis points to the left, the y-axis points into the viewing direction of the user, as illustrated by the nose 52 of the head 50, (which is the upward direction in the paper plane) and a z-axis pointing into the direction of gravity (which is towards the paper plane of FIG. 2), with both hearing aids 10, 11 using the same coordinate system. In case of rotation of the head with constant angular velocity, the acceleration—apart from gravity—has only a centripetal component (i.e. an x-component, which is directed towards the center of rotation), so that the integrated acceleration, i.e. the velocity, has only a tangential component (i.e. an y-component).

In this coordinate system, the tangential displacement of the hearing aid 10, which is worn at the right ear 60 of the user's head 50 in the example of FIG. 2, is in the direction of increasing y-values ("+y"-direction) in case of a counter-clockwise rotation of the user's head, whereas the tangential displacement of the hearing aid 11, which is worn at the left ear 61 in the example of FIG. 2, is in the is in the direction of decreasing y-values ("−y"-direction). In the example of FIG. 2, a forward tangential displacement is in the "+y"-direction, whereas a rearward tangential displacement is in the "−y"-direction. In case of a clockwise rotation of the user's head (as detected from the orientation signal provided by the orientation sensor 44), the directions of the tangential displacement, as obtained from the integration of the acceleration signal over time, would be just reverse to the counter-clockwise case, i.e. for a clockwise rotation, the tangential displacement of the right ear hearing aid 10 would be rearward, and the tangential displacement of the left ear hearing aid 11 would be forward.

Consequently, for each hearing aid 10, 11 the side/ear at which it is presently worn can be determined by using the following truth table, since in case of a counter-clockwise rotation of the head 50 (as corresponding to a decreasing value of the azimuthal component of the orientation signal) the hearing aid 10 worn at the right ear experiences a forward tangential displacement, whereas the hearing aid 11 worn at the left ear experiences a rearward tangential displacement; in case of a clockwise rotation (as evident from an increasing azimuthal value of the orientation signal), the right ear hearing aid 10 experiences a rearward tangential displacement, whereas the left ear hearing aid 11 experiences a forward tangential displacement.

| | Left hearing aid | | Right hearing aid | |
|---|---|---|---|---|
| Rotation | Azimut reading | Tangential displacement | Azimut reading | Tangential displacement |
| Counter-clockwise | Decreasing | Rearward | Decreasing | Forward |
| Clockwise | Increasing | Forward | Increasing | Rearward |

In order to avoid side judgements which are not based on an actual active rotation of the user's head 50 with regard to the user's body, such as it may occur when the user is sitting in a car (e.g. when driving at a roundabout), it may be helpful to apply appropriate pattern filtering to the orientation signal and the acceleration signal (i.e. head movement which is not due to rotation of the head relative to the body may be recognized by carefully analyzing the orientation signal and the acceleration signal).

In principle, in the embodiment illustrated in FIG. 2 wherein each hearing aid 10, 11 senses its own acceleration signal and orientation signal, the judgement unit 40 of each aid may detect on its own, without using signals from the other hearing aid, whether it is presently worn at the right ear or at the left ear. However, the reliability of the side detection may be enhanced by exchanging the orientation signals and the acceleration signals between the hearing aids, or by exchanging at least the result of the side detection, so that plausibility of the results can be checked (in any case, the two hearing aids have to come to the conclusion that they are worn at different sides).

While each of the hearing aids may comprise its own judgement unit 40, embodiments are conceivable wherein only one of the hearing aids is provided with a judgement unit 40 which receives directly for the local side and wirelessly for the remote side the orientation signals and acceleration signals from the sensors 42, 44 of both hearing aids in order to detect the side of each hearing aid, with the result of the judgement for the hearing aid not having a judgement unit 40 being transmitted to that hearing aid via the wireless binaural link 30.

When analyzing the acceleration signal, noise may be reduced by removing acceleration components which were not related to a rotation of the user's head (such as signal components due to gravity); this may be achieved by comparing the acceleration signals of the two hearing aids and by removing acceleration signal components which are identical for both hearing aids from the acceleration signal of the two hearing aids.

Figure 3:
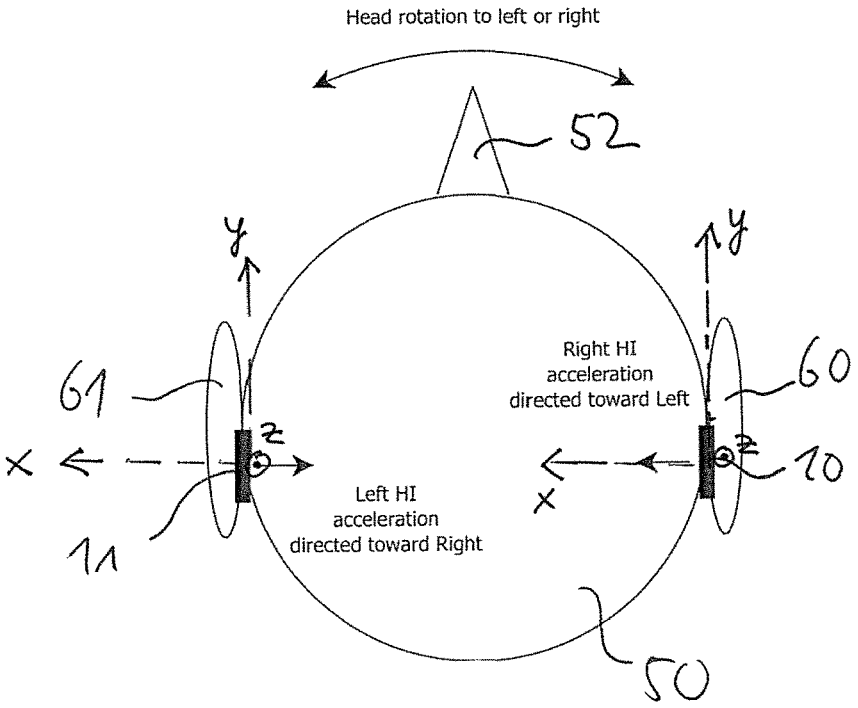
FIG. 3 is an illustration similar to FIG. 2, wherein, however, an alternative of an automatic side detection of a hearing assistance system of the invention is shown.

In FIG. 3 an alternative embodiment is illustrated, wherein the signal processing in the judgement unit 40 does not require an orientation signal, so that the orientation sensors 44 may be omitted in the hearing aids 10, 11, thereby simplifying the hearing aids. However, a side detection based on the acceleration signal only typically will require a binaural implementation in order to be sufficiently reliable, e.g. the (or each) judgement unit 40 is to be provided with the acceleration signal of both hearing aids, so that the acceleration signals of the two hearing aids can be compared in order to perform the side detection.

As in the embodiment of FIG. 2, each hearing aid 10, 11 may be provided with a judgement unit 40. Alternatively, when using a "master-slave" configuration, only one of the hearing aids (which then acts as the master) comprises a judgement unit 40, whereas the other hearing aid (acting as the slave) does not include a judgement unit but receives the result of the side detection from the master hearing aid via the binaural link 30.

Since in the embodiment of FIG. 3 usually no orientation signal indicating head rotation is available, the acceleration signals have to be used for detecting head rotation. This can be done by determining, in the judgement unit 40, the difference between the acceleration signal of the first hearing aid 10 and the second hearing aid 11, wherein a side judgement is initiated when the determined acceleration signal difference is found to be above a given threshold. This principle utilizes the fact that only for rotational motion of the head significant differences in the acceleration signals between the right ear hearing aid and the left ear hearing aid are to be expected; in contrast, for translational movement of the head the acceleration acting on the two hearing aids will be essentially the same, so that the difference will be very small. As can be seen in FIG. 3, for head rotation both in the clockwise direction or in the counter-clockwise direction the respective acceleration (which has only a component along the x-axis) will be opposite for the two hearing aids, so that the difference is maximal.

In case that the judgement unit 40 does not know whether the head rotation is in a clockwise sense or in a counter-clockwise sense, the side detection method illustrated in FIG. 2, which uses the time-integrated acceleration, would not work, since the truth table associated with the method of FIG. 2 requires the head rotation sense as a parameter (the time-integrated acceleration alone is not sufficient for a side judgement).

By contrast, in the embodiment of FIG. 3 the acceleration signal as such (i.e. the x-component in FIG. 3) is analyzed for determining the side of the respective hearing aid (as already mentioned above, for head rotation with a constant angular velocity the acceleration signal—apart from gravity—will only have an x-component, so that the integrated acceleration, i.e. the velocity, will only have an y-component as shown in FIG. 2).

The method of FIG. 3 utilizes the fact that the direction of the acceleration at both sides of the head does not depend on the sense of the head rotation, i.e. both hearing aids will experience an acceleration towards the center of the head both for clockwise head rotation and for counter-clockwise head rotation, so that the direction of the acceleration of the right ear hearing aid 10 is always in a leftward direction, i.e. in the direction of increasing x-values ("+x"-direction), whereas the left ear hearing aid 11 will experience an acceleration in a rightward direction, i.e. in the direction of decreasing x-values ("−x"-direction). Thus, the hearing aid detecting acceleration along the +x-direction is presently worn at the right ear, and the hearing aid detecting acceleration along the −x-direction is presently worn at the left ear.

Thus, while in principle the side detection in each hearing aid does not actually require knowledge of the acceleration signal of the other hearing aid, knowledge of the acceleration signal of both hearing aids is, however, necessary for reliably detecting head rotation, which, in turn, is necessary for determining a good point in time for doing the side judgement (as mentioned above, head rotation may be detected by monitoring the difference between the two acceleration signals of the right ear hearing aid and the left ear hearing aid).

Of course, it is also possible to combine the embodiments of FIGS. 2 and 3 in that in the embodiment of FIG. 2, in addition to using the integrated acceleration signal and the orientation signal for determining the side, the acceleration signal as such may be taken into account for enhancing plausibility of the side detection.

An example for a three-axes combined magnetometer and accelerometer sensor is a circuit available under the designation "LMS 303C" from the company ST Microelectronics, which includes a three-axes magnetometer and a three-axes accelerometer in a single casing measuring 2×2×1 $mm^3$ and which consumes a few hundred μA on 2 V.

An example for an accelerometer only sensor is a triaxial accelerometer available from Bosch Sensortec under the designation "BMA255" in a casing measuring 2×2×0.95 mm and consuming 130 μA at a voltage down to 1.2 V.

As already mentioned above, a valid judgement of the side at which the respective hearing device is presently worn requires a proper head rotation by the user after power-on of the hearing device. However, it may happen that the user does not rotate his/her head for a while, or that the head movement is too slow or noisy to deliver proper results. In such case, it is necessary to control operation of the hearing device during the period of time between power-on and the first valid judgement without actual knowledge of the side at which the hearing device is presently worn. Such control may use, for example, one of the following options:

(1) Each hearing device may apply the fitting parameters corresponding to the side of the last wearing session. This is the a preferred option, since the wearing side is quite clear during normal use due to the shape of the receiver or the tubing, and it is normally unknown or wrong at initial use in the audiologist's shop or after servicing or cleaning, which situations, however, are rather exceptional.

(2) Each hearing device may apply default values. This is a less preferred option, since it might be risky in case of an asymmetric hearing loss (the strong side may receive large amplification while the weak side may receive a small signal only); also, it may be difficult to determine reasonable default values.

(3) Each hearing device may apply on both ears an "average of both sides" fitting. Also this option is less preferred, since it involves similar risks as the previous option, although mitigated by the averaging process, which will reduce the maximum power output and increase the minimal power.

The accelerometer sensor 42 and the orientation sensor 44, in addition to their use in the side detection by the judging unit 40, may provide for additional functionality to the hearing aid. For example, the orientation signal and the acceleration signal may be used for implementing an automatic power on/off function, wherein the hearing device is automatically turned off if it is found from the acceleration signal that the hearing device has been lying down for more than a given time period (i.e. the orientation with regard to the direction of gravity is different than in normal use and there has been no acceleration/movement for a certain time period), while the hearing device is automatically turned on when movement of the hearing device is detected from the acceleration signal.

According to another example, an acoustic beamformer of the hearing device could be controlled according to the detected head orientation (which can be detected from the orientation of the hearing devices when being worn at the head; the orientation of the hearing devices can be detected from the acceleration signal which is indicative of the direction of gravity): For example, if the user is found to lie in bed, the beamformer could be switched off in order to switch to an omnidirectional microphone characteristic, since the normal beamforming in such situation would result in a beam pointing upwards, in which direction no useful sound sources are to be expected.

According to another example, the sound processing program which is presently applied in the audio signal processing unit 14 may be automatically adapted or selected depending on the physical activity (practicing sport, walking, or being calm) as detected by analyzing the acceleration signal (and orientation signal).

According to a further example, the acceleration signal may be used to detect when the hearing device is falling down, which may be an indication that the hearing device has been lost by the user or that the user is falling down together with the hearing device. Such falling down detection may be used, for example, for warranty limitation purposes or for health monitoring of the user.

The acceleration signal also could be used for detecting a "finger tap" acting on the hearing device, whereby a kind of push-button functionality may be implemented without having a mechanical button.

The present invention is particularly beneficial in that it removes the need for physical marking of the hearing devices for preventing interchange of the sides at which they are worn, while having on the small additional footprint (the additional power requirements are low and only very few data has to be exchanged between the hearing devices via the binaural link (only exchange of some acceleration data is required, and this only during a measurement period after startup of the hearing device)); this is in particular the case if space already used by a GMR sensor can be reused (the sensors of the present invention may replace such GMR sensor). Further, the additional sensors required for the automatic side detection may provide for additional useful functionality.

The invention claimed is:

1. A hearing assistance system, comprising:

a first hearing device to be worn at one ear of a user, the first hearing device comprising a 3-axes accelerometer sensor for generating an acceleration signal indicative of an acceleration of the first hearing device, an orientation sensor for generating an orientation signal indicative of an azimuthal orientation of the first hearing device, a judgement unit configured to determine a difference between the acceleration signal and an acceleration signal of a second hearing device included in the hearing assistance system, and initiate, once the determined acceleration signal difference is above a given threshold value, a judgement as to whether the first hearing device is presently worn at the right ear or at the left ear of the user, the judgement based on the acceleration signal of the first hearing device and the orientation signal of the first hearing device, a memory for storing both a right ear fitting parameter set for the right ear and a left ear fitting parameter set for the left ear, and a controller for controlling an operation of the first hearing device, the controller configured to cause the first hearing device to use either the right ear fitting parameter set or the left ear fitting parameter set based on the judgement unit judging whether the first hearing device is presently worn at the right ear or at the left ear.

2. The system of claim 1, wherein the judgement unit is implemented in the first hearing device and is configured to analyze the acceleration signal and the orientation signal of the first hearing device only.

3. The system of claim 2, wherein the judgement unit is further configured to initiate the judgement as to whether the first hearing device is presently worn at the right ear or at the left ear of the user once a change of an azimuthal orientation of the first hearing device, as determined from a change of the orientation signal with time, is above a given threshold value.

4. The system of claim 2, wherein the judgement unit is configured to integrate the acceleration signal over time in order to determine a direction of a tangential displacement of the first hearing device with regard to the user's head.

5. The system of claim 4, wherein the judgement unit is configured to judge that the first hearing device is presently worn at the left ear if the determined direction of the tangential displacement is along a forward direction when the orientation signal is representative of a clockwise rotation of the user's head, when seen in a direction of gravity, or if the determined direction of the tangential displacement is along a rearward direction when the orientation signal is representative of a counter-clockwise rotation of the user's head and to judge that the first hearing device is presently worn at the right ear if the determined direction of the tangential displacement is along a rearward direction when the orientation signal is representative of a clockwise rotation or if the determined direction of the tangential displacement is along a forward direction when the orientation signal is representative of a counter-clockwise rotation, wherein the first hearing device has a predefined forward direction and a rearward direction with regard to a vertical direction, wherein the forward direction is predefined in such a manner that it substantially coincides, when the first hearing device is worn at an ear of the user, with a viewing direction of the user.

6. The system of claim 1, wherein the hearing assistance system comprises the second hearing device to be worn at the other ear of the user, the second hearing device comprising a 3-axes accelerometer sensor for generating the acceleration signal of the second hearing device and a 3-axes magnetic compass sensor for generating an orientation signal indicative of an azimuthal orientation of the second hearing device, wherein each of the hearing devices comprises an interface for data exchange with the other hearing device, and wherein the judgement unit is configured to judge, by taking into account the acceleration signal of both the first and second hearing device and the orientation signal of at least one of the first and second hearing device, for each hearing device whether it is presently worn at the right or at the left ear of the user.

7. The system of claim 6, wherein the judgement unit is implemented in the first hearing device, wherein the first hearing device is configured to transmit a control signal to the second hearing device indicative of whether the second hearing device is presently worn at the right ear or at the left ear of the user, wherein at least one of the acceleration signal and the orientation signal of the second hearing device is transmitted from the second hearing device to the first hearing device via the data exchange interface.

8. The system of claim 6, wherein the judgement unit comprises a first part implemented in the first hearing device and a second part implemented in the second hearing device, wherein each part is configured to judge whether the respective hearing device is presently worn at the right ear or at the left ear of the user.

9. The system of claim 6, wherein the judgement unit is configured to initiate the judgement as to at which ear of the user the first and second hearing device are presently worn once a change of the azimuthal orientation of at least one of the first and second hearing device, as determined from a change of the respective orientation signal with time, is above a given threshold value.

10. The system of claim 6, wherein the judgement unit is configured to integrate the acceleration signal of the respective hearing device over time in order to determine a direction of a tangential displacement of the respective hearing device with regard to the user's head.

11. The system of claim 6, wherein the judgement unit is configured to judge that the respective hearing device is presently worn at the left ear if the determined direction of a tangential displacement is along a forward direction when the orientation signal is representative of a clockwise rotation of the user's head, when seen in the direction of gravity, or if the determined direction of the tangential displacement is along a rearward direction when the orientation signal is representative of a counter-clockwise rotation of the user's head and to judge that the respective hearing device is presently worn at the right ear if the determined direction of the tangential displacement is along a rearward direction when the orientation signal is representative of a clockwise rotation or if the determined direction of the tangential displacement is along a forward direction when the orientation signal is representative of a counter-clockwise rotation, wherein the hearing devices have a predefined forward direction and a rearward direction with regard to a vertical direction, wherein the forward direction is predefined in such a manner that it substantially coincides, when the first hearing device is worn at an ear of the user, with the viewing direction of the user.

12. The system of claim 6, wherein the judgement unit is configured to subtract, by comparing the acceleration signal of the first hearing device and the second hearing device, portions of the acceleration signal which are identical for both hearing devices from the acceleration signal of the first hearing device and from the acceleration signal of the second hearing device, so as to reduce noise by removing acceleration components which are not related to a rotation of the user's head.

13. The system of claim 6, wherein the judgement unit is configured to detect a clockwise rotation of the user's head when the azimuthal value of the orientation signal increases in time, and to detect a counter-clockwise rotation of the user's head when the azimuthal value of the orientation signal decreases in time.

14. The system of claim 1, wherein the hearing device is configured to control an audio signal processing in the hearing device according to a physical activity of the user, as detected by analyzing the acceleration signal.

15. The system of claim 1, wherein:

if the judgment unit judges that the first hearing device is presently worn at the right ear, the controller causes the first hearing device to use the right ear fitting parameter set; and if the judgment unit judges that the first hearing device is presently worn at the left ear, the controller causes the first hearing device to use the left ear fitting parameter set.

16. The system of claim 6, wherein the data interfaces are configured for establishing a wireless data link between the data interfaces.

17. The system of claim 16, wherein the wireless link uses a Bluetooth protocol or a proprietary protocol.

18. The system of claim 16, wherein the wireless link is an inductive link.

19. The system of claim 6, wherein the hearing devices are hearing instruments comprising a microphone arrangement for capturing input audio signals from ambient sound, an audio signal processing unit for generating a hearing stimulation signal form the input audio signals, and an ear-level output transducer for stimulating the user's hearing according to the stimulation signal.

20. The system of claim 6, wherein the judgement unit is configured to perform the judgment as to whether the respective hearing device is presently worn at the right ear or at the left ear of the user only once after each power-on action of the respective hearing device.

21. The system of claim 6, wherein the judgement unit is configured to periodically perform a judgment as to whether the respective hearing device is presently worn at the right ear or at the left ear of the user after each power-on action of the respective hearing device.

22. The system of claim 6, wherein each hearing device is configured to automatically switch off when an analysis of the acceleration signal indicates that the hearing device has not been moving for at least a given time period and/or that the present orientation of the hearing device with regard to gravity deviates from a predefined use orientation.

23. The system of claim 6, wherein each hearing device is configured to control an acoustic beamformer according to a head orientation as detected by analyzing the acceleration signal of each respective hearing device.

24. The system of claim 6, wherein each hearing device is configured to detect a fall-down event of each respective hearing device by analyzing the acceleration signal of each respective hearing device.

25. The system of claim 23, wherein each hearing device is configured to switch the acoustic beamformer into an omnidirectional mode when the head is found to be lying.

26. The system of claim 19, wherein the hearing devices are hearing aids or auditory prosthesis devices.

27. The system of claim 26, wherein the hearing devices are BTE hearing aids or RIC hearing aids.

28. The system of claim 26, wherein the hearing devices are cochlear implant devices comprising a BTE sound processor.

29. A hearing assistance system, comprising:

a first hearing device to be worn at a first ear of a user; and a second hearing device to be worn at a second ear of the user, wherein each of the hearing devices comprises an interface for data exchange with the other hearing device and a 3-axes accelerometer sensor for generating an acceleration signal indicative of an acceleration of the respective hearing device; and a judgement unit configured to determine a difference between the acceleration signal of the first hearing device and the acceleration signal of the second hearing device, and initiate, once the determined acceleration signal difference is above a given threshold value, a judgement as to whether each of the respective hearing devices is presently worn at the right ear or at the left ear of the user.

30. The system of claim 29, wherein the judgement unit is implemented in the first hearing device, wherein the second hearing device is configured to transmit its acceleration signal to the first hearing device, and wherein the first hearing device is configured to transmit a control signal to the second hearing device indicative of whether the second hearing device is presently worn at the right ear or at the left ear of the user.

31. The system of claim 29, wherein the judgement unit comprises a first part implemented in the first hearing device and a second part implemented in the second hearing device, wherein each part is configured to judge whether the respective hearing device is presently worn at the right ear or at the left ear of the user.

32. The system of claim 29, wherein the judgement unit is configured to judge that the respective hearing device is presently worn at the right ear if its acceleration is in a leftward direction, when seen in the direction of gravity, and to judge that the respective hearing device is presently worn at the left ear if its acceleration is in a rightward direction, when seen in the direction of gravity, wherein each hearing device has a predefined rightward direction and leftward direction with regard to a vertical direction.

33. A method of detecting a side of a user's head at which a first hearing device is presently worn, comprising:

generating, by utilizing an orientation sensor of the first hearing device, an orientation signal indicative of the azimuthal orientation of the first hearing device;

generating, by utilizing a 3-axes accelerometer sensor of the first hearing device, an acceleration signal indicative of a acceleration of the first hearing device;

determining a difference between the acceleration signal and an acceleration signal of a second hearing device of the user; and initiating, once the determined acceleration signal difference is above a given threshold value, a judgement as to whether the first hearing device is presently worn at the right ear or at the left ear of the user, the judgement based on the acceleration signal of the first hearing device and the orientation signal of the first hearing device.

34. The method of claim 33, further comprising:

determining, from the acceleration signal of the first hearing device, a tangential displacement of the first hearing device with regard to a head of the user, and using the determined tangential placement, together with the orientation signal, for judging whether the first hearing device is presently worn at the right ear or at the left ear of the user.

35. The method of claim 34, wherein the tangential displacement of the hearing device with regard to the head of the user is determined by integrating the acceleration signal over time.

36. The method of claim 33, wherein operating parameters of the first hearing device are selected according to a result of the judgement concerning the ear at which the first hearing device is presently worn.

37. A method of detecting the respective side of a user's head at which each of a first hearing device and a second hearing device of a binaural system is presently worn, comprising:

generating, by utilizing a 3-axes accelerometer sensor of each of the hearing devices, an acceleration signal indicative of the acceleration of the respective hearing device; and determining a difference between the acceleration signal of the first hearing device and the acceleration signal of the second hearing device, and initiating, once the determined acceleration signal difference is above a given threshold value, a judgement as to whether each of the respective hearing devices is presently worn at the right ear or at the left ear of the user.

38. The method of claim 37, wherein operating parameters of the first hearing device and the second hearing device are selected according to a result of the judgement concerning the ear at which each respective hearing device is presently worn.

* * * * *